US006957653B2

(12) United States Patent
Campbell et al.

(10) Patent No.: US 6,957,653 B2
(45) Date of Patent: Oct. 25, 2005

(54) FLUSHED-SEAL RESPIRATOR

(75) Inventors: Donald L. Campbell, Morgantown, WV (US); Christopher C. Coffey, Morgantown, WV (US); William A. Hoffman, Washington, PA (US); Judith B. Hudnall, Morgantown, WV (US)

(73) Assignee: The United States of America as represented by the Secretary of the Department of Health and Human Services, Washington, DC (US)

( * ) Notice: Subject to any disclaimer, the term of this patent is extended or adjusted under 35 U.S.C. 154(b) by 39 days.

(21) Appl. No.: 10/297,883

(22) PCT Filed: Jun. 12, 2001

(86) PCT No.: PCT/US01/40957

§ 371 (c)(1),
(2), (4) Date: Dec. 10, 2002

(87) PCT Pub. No.: WO01/97915

PCT Pub. Date: Dec. 27, 2001

(65) Prior Publication Data

US 2003/0131846 A1 Jul. 17, 2003

Related U.S. Application Data

(60) Provisional application No. 60/212,459, filed on Jun. 19, 2000.

(51) Int. Cl.[7] ..... A62B 18/02

(52) U.S. Cl. ..... 128/206.21; 128/206.24; 128/207.11

(58) Field of Search ..... 128/201.29, 206.21, 128/206.23, 206.26, 207.11, 206.24, 207.4

(56) References Cited

U.S. PATENT DOCUMENTS

| | | | | | |
|---|---|---|---|---|---|
| 3,481,333 | A | * | 12/1969 | Garrison | 128/201.28 |
| 3,680,555 | A | | 8/1972 | Warncke | |
| 3,935,861 | A | | 2/1976 | Warncke | |
| 4,414,973 | A | * | 11/1983 | Matheson et al. | 128/206.15 |
| 4,926,855 | A | * | 5/1990 | Hellquist et al. | 128/201.28 |
| 5,526,804 | A | * | 6/1996 | Ottestad | 128/201.25 |
| 5,655,527 | A | | 8/1997 | Scarberry et al. | |
| 6,102,034 | A | * | 8/2000 | Buhlmann | 128/201.29 |
| 6,478,025 | B1 | * | 11/2002 | Yort et al. | 128/201.25 |

FOREIGN PATENT DOCUMENTS

| | | | | | |
|---|---|---|---|---|---|
| GB | 800600 | | | 8/1958 | |
| GB | 2201096 | A | * | 8/1988 | A62B/7/00 |
| GB | 2211098 | A | * | 6/1989 | A62B/18/02 |
| GB | 2247396 | A | * | 3/1992 | A62B/7/02 |

* cited by examiner

*Primary Examiner*—Glenn K. Dawson
*Assistant Examiner*—Darwin P Erezo
(74) *Attorney, Agent, or Firm*—Klarquist Sparkman LLP

(57) ABSTRACT

Improved full-face, flushed-seal respirators are provided having a primary sealing element adjacent to a breathing space and a secondary sealing element. Exhaled air (i.e., clean air obtained by passage through a filtering element or elements) is passed from the breathing space into a flushing channel formed between the primary and secondary seals. If there is leakage in the primary seal, air from this flushing channel leaks into the breathing space rather than ambient air. Air within the flushing channel will predominately be air that has already passed through the filtering elements. The present invention provides, therefore, an inexpensive respirator which provides significantly more protection than conventional negative-pressure respirators.

20 Claims, 2 Drawing Sheets

FLUSHED-SEAL RESPIRATOR

PRIORITY CLAIM

This is a §371 U.S. national stage of PCT/US01/40957, filed Jun. 12, 2001, which was published in English under PCT Article 21(2), and claims the benefit of U.S. Provisional Application Ser. No. 60/212,459, filed Jun. 19, 2000.

This invention relates to air purifying respirators of the negative-pressure type and, more particularly, to full-face, flushed-seal respirators having a primary sealing element adjacent to the breathing space.

The most common respirator type is the non-powered, negative pressure, air-purifying respirator. It is generally the least expensive and the simplest to use and maintain. During use, the wearer inhales, creates a slight negative pressure inside the facepiece of the respirator, whereby contaminated air is drawn through filters and thereby purified. The protection level is, however, limited by the leakage that occurs between the sealing member of the respirator and the face. The same negative pressure that draws air through the filters also tends to draw contaminated air through leaks that are unavoidable between the face and the respirator. Even with proper usage, well designed (i.e., good face-fitting characteristics) conventional respirators can have leakage rates of up to about 10 percent for a half-face respirator and up to about 2 percent for a full-face respirator.

Several approaches have been used to provide improved respirators with increased levels of protection. For example, powered, air-purifying respirators (PAPR) utilize a battery-operated blower to force the contaminated air through the filters and thus reduce the negative pressure that may cause faceseal leakage. These positive pressure respirators are generally more costly, more complex, more cumbersome, and more difficult to use than conventional negative-pressure respirators. Batteries to power the units are generally heavy to carry. If such batteries are not carried by the user (i.e., mounted on fixed or movable structures), the mobility of the user can be significantly restricted or reduced. Since the batteries must be recharged regularly, downtime can be significant. Since the required blowers are noisy, ear protection is often required. Such respirators are also expensive to purchase and maintain. Additionally, since the respirators are difficult and cumbersome to use, there may be a tendency for workers not to use them, or to use them improperly, thereby increasing the worker's risk of exposure to hazardous materials.

Air-line respirators using an air line or hose to deliver compressed, clean air to the respirator have also been developed. The high pressure in the air line is reduced to a usable level with a pressure-regulator or a flow-regulator, which is typically mounted on the wearer's belt. The concept is to reduce the negative pressure inside the respirator during inspiration and thereby reduce faceseal leakage. Such positive-pressure respirators require a source of clean, high-pressure air. Thus, the systems are expensive to install and maintain and can themselves be dangerous if not used properly and with caution. Wearers are greatly encumbered by the need to drag an air hose behind them, thereby limiting their mobility. During use, accidental cutting or crimping of the air line can also expose the wearer to significant danger.

The trailing air line can also catch or snag on obstacles or be covered by falling debris or objects, thereby limiting the ability of the wearer to exit the hazardous area. Moreover, these positive-pressure air-line respirators are also expensive to purchase and maintain.

Although powered air-purifying respirators and air-line respirators can provide increased levels of protection against leakage, they both suffer from a number of the disadvantages discussed above.

Thus, a need for an improved non-powered, negative-pressure, air-purifying respirator still remains which will provide improved protection without the many disadvantages normally associated with conventional respirators. The present invention provides such improved negative-pressure respirators.

Our invention provides an improved respirator of the so-called flushed-seal type. It comprises a respirator facepiece provided with a primary seal that forms a seal with the user's face to achieve a breathing space around the users mouth and nose separate from the surrounding ambient atmosphere. The facepiece further comprises a secondary seal also forming a seal with the user's body. The secondary seal provides a flushing channel between the primary and secondary seals which serves to pass air from the breathing space into the flushing channel when the user exhales.

Exhaled air (i.e., clean air obtained through the filtering element or elements) is thus passed through the channel formed between the primary and secondary seals. If there is any leakage in the primary seal, air from the flushing channel is what leaks into the breathing space instead of ambient air. Inasmuch as air within the flushing channel is predominately air that has already passed through the filtering elements of the respirator, our invention provides an inexpensive respirator that provides greatly increased protection in comparison with conventional negative-pressure respirators.

DETAILED DESCRIPTION

The disclosed respirators are designed so that the air adjacent to, but outside of, the breathing space defined by the primary sealing member is contained in a separate passageway (i.e., the flushing channel or chamber) and is isolated from the ambient atmosphere. It is the air from the breathing space that is used to replenish the air in the flushing channel. Since air in the breathing space has been passed through, and purified by, the filtering element or elements, the air in the flushing channel remains significantly cleaner than the ambient atmosphere. Thus, any air leaking into the breathing space from around the primary seal will be the clean air contained in the flushing channel. The use of such a flushing channel in a negative-pressure respirator provides significantly improved performance and safety.

Figure 1:
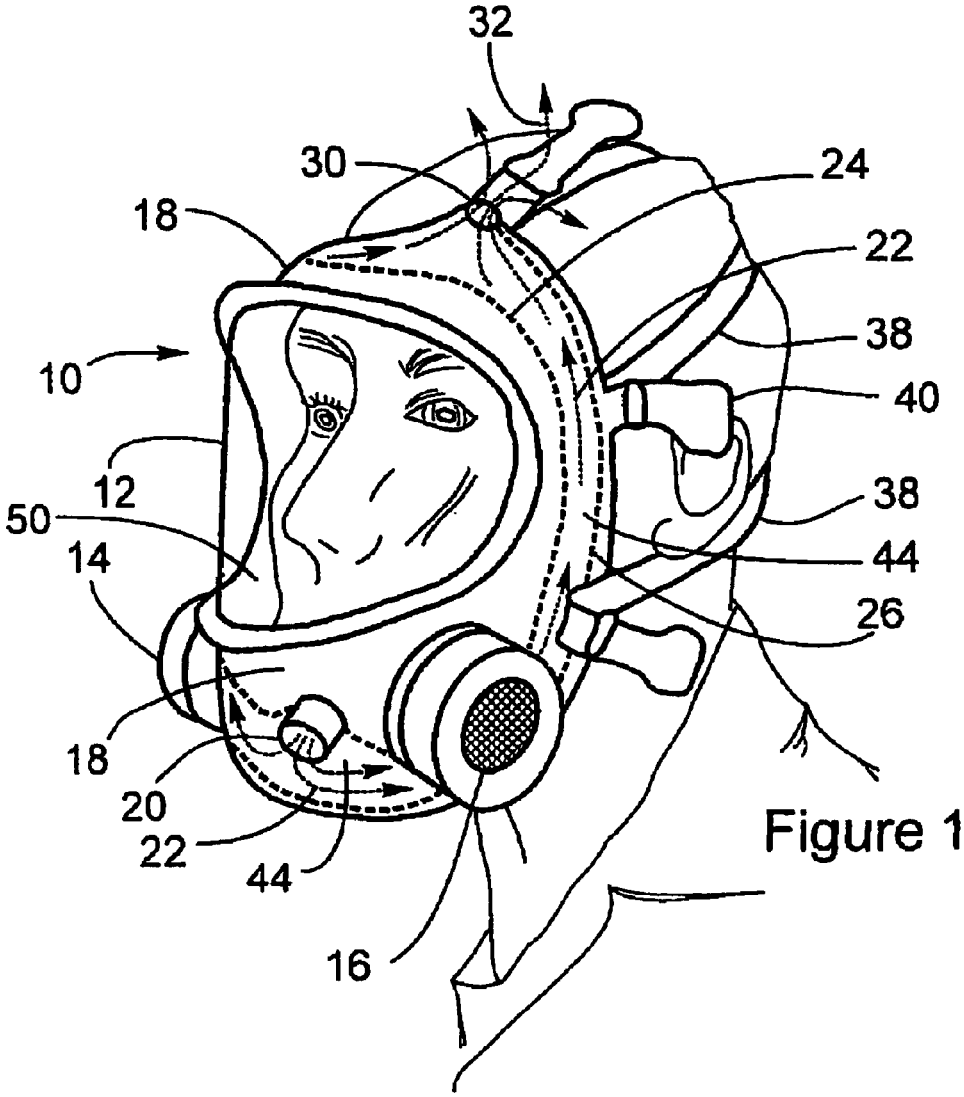
FIG. 1 illustrates a full-face respirator in accordance with the present invention.
Figure 5:
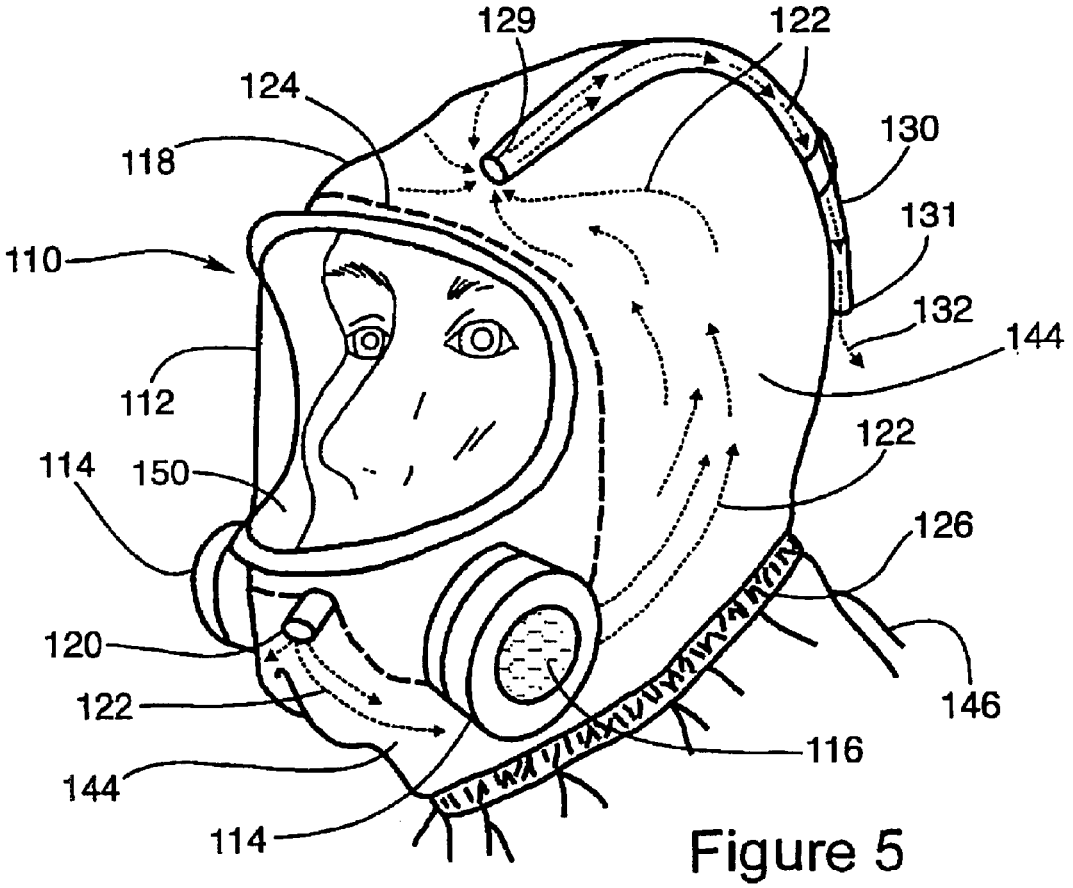
FIG. 5 illustrates a hooded full-face respirator in accordance with the present invention wherein the secondary seal is located around the user's neck.

FIGS. 1 and 5 illustrate a full-face respirator and a hooded full-face respirator, respectively, incorporating the flushing channel of our invention. Of course, the flushing channel of this invention could be adapted to other types of respirators (e.g., half-mask respirators). The respirators of this invention comprise (1) a respirator facepiece, wherein the facepiece can be attached to the user's head to cover the user's mouth and nasal passages; (2) a primary seal attached to the respirator facepiece to form a seal with the users face and which forms a breathing space around the mouth and nasal passages; (3) a secondary seal attached to the respirator facepiece to form a seal with the user's body such that a flushing channel is formed by the user's body, the primary seal, the secondary seal, and the respirator facepiece, whereby the flushing channel is separated from the breathing space by the primary seal; (4) at least one air filter inlet mounted on the respirator facepiece and having a filtering element, whereby air from outside the respirator facepiece, when the user inhales, passes though the filtering element into the breathing space, but air within the breathing space, when the user exhales, cannot pass through the filtering element in a reverse direction; (5) at least one exit passageway to provide communication between the breathing space and the flushing channel, whereby air, when the users exhales, passes from the breathing space into the flushing channel, but air within the flushing channel, when the user inhales, cannot pass through the exit passageway in a reverse direction; and (6) an outlet passageway located on the respirator facepiece at a location remote from the exit passageway to allow air within the flushing channel to exit from the flushing channel into the air outside the respirator facepiece; whereby air exhaled by the user passes into, and flows through, the flushing channel from the breathing space, such that, if the primary seal leaks, air entering through the leak in the primary seal will be air from the flushing channel.

Preferably, the respirator is of the full-face type wherein the user's eyes are also located within the breathing space and thus, the respirator facepiece also has a viewing area. Preferably, the flushing channel contains one or more spacing elements to maintain the flushing channel in an open configuration to allow the exhaled air to pass more freely though the flushing channel. The outlet passageway which allows air from the flushing channel to exit from the respirator to the outside environment is preferably equipped with a check valve or other mechanism to prevent air from the outside environment from entering the flushing channel through the outlet passageway.

FIG. 1 illustrates a full-face respirator 10 having an outer covering or facepiece 18 and a viewing area 12. A breathing space 50 is thus formed around the user's mouth and nose and is defined by a primary seal or faceseal 24, the user's face and the interior surfaces of the respirator that are enclosed by the primary seal 24. At least one air filter inlet 14 having a filtering element 16 is attached to the facepiece 18, whereby air from outside the respirator facepiece 18 passes though the filtering element 16 into the breathing space 50 when the user inhales. Preferably, the respirator has at least two such air filtering inlets 14, each with its own filtering element 16. Each air filter inlet 14 is designed such that air within the breathing space 50 cannot pass through the filtering element 16 in a reverse direction when the user exhales; i.e., air cannot pass from the breathing space 50 through the filtering element 16 to the ambient atmosphere.

Instead, air from the breathing space 50 exits from the breathing space 50 via at least one exit passageway or exhalation valve 20. Thus, when the users exhales, air from the breathing space 50 passes into a flushing channel 44. However, air within the flushing channel 44 cannot pass through the exit passageway 20 in a reverse direction when the user inhales; i.e., air cannot pass from the flushing channel 44 back into the breathing space. Preferably, both the air inlet 14 and the exit passageway 20 have check valves or other one-way flow valves that allow movement of air in the desired direction, but that prevent movement of air in the reverse direction.

Figure 2:
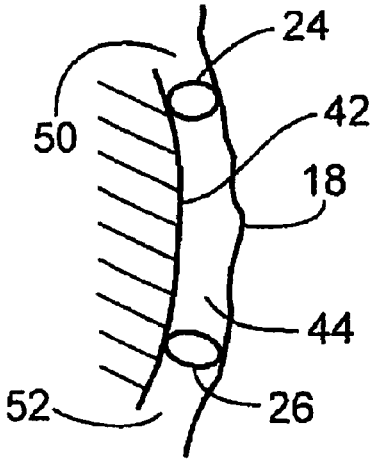
FIG. 2 is a sectional view illustrating the primary and secondary seals as well as the flushing channel of the full-face respirator of FIG. 1.
Figure 3:
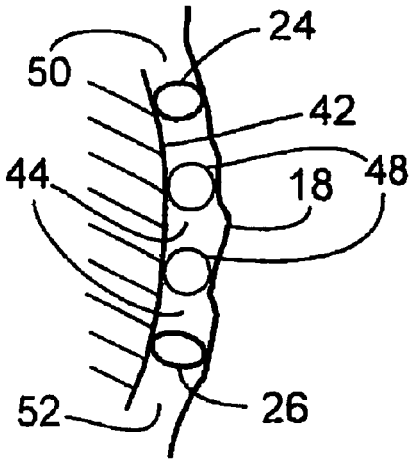
FIG. 3 is a sectional view illustrating the flushing channel of FIG. 2 having two spacing elements to help maintain the flushing channel in an open configuration.
Figure 4:
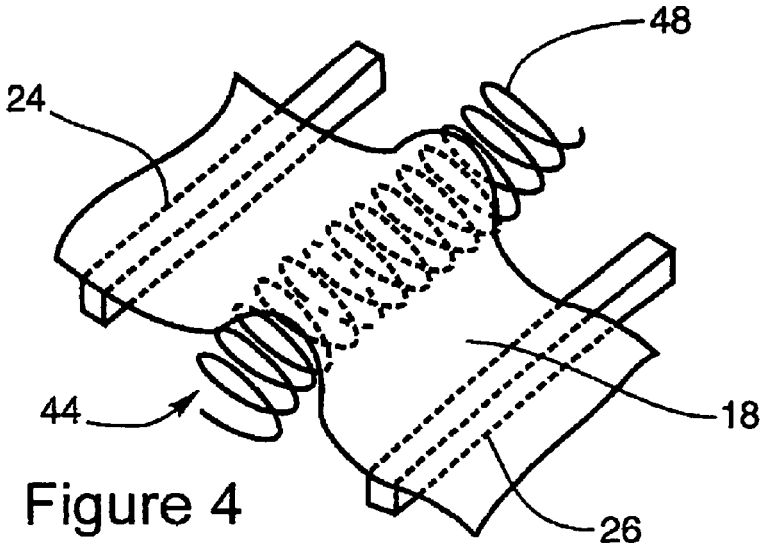
FIG. 4 is a partial side view of a flushing channel using a spiral wire spacing element to maintain the flushing channel in an open configuration.

The flushing channel 44, which is best seen in FIGS. 2, 3, and 4, is defined by the primary seal 24, a secondary seal 26, the body surfaces 42 between the primary and secondary seals 24 and 26, respectively, and the interior surface of the respirator outer covering or facepiece 18 between the primary and secondary seals 24 and 26, respectively. In operation, air is drawn through the filtering element 16 into the breathing space 50 when the user inhales. When the user exhales, air within the breathing space 50 is forced through the exit passageway 20 and into the flushing channel 44. Air in the flushing channel 44 flows (as generally indicated by arrows 22) through the flushing channel 44 to an outlet passageway 30. The outlet passageway 30 is located on the respirator facepiece 18 such that air from the flushing channel 44 can exit to the ambient atmosphere, following a path generally indicated by air flow arrows 32.

In the disclosed embodiment, the outlet passageway 30 is located remote from the exit passageway 20, whereby the air flow through the flushing channel 44 will tend to be uniform (i.e., the flowing air will tend to sweep out the entire flushing channel).

Generally, the exit passageway 20 be located near the user's mouth and the outlet passageway 30 be located near the top or back of the user's head. As shown in FIG. 1, the outlet passageway 30 is located at the top of the respirator 10 and at the far end of the flushing channel 44 relative to the exit passageway 20. Thus, the air flow 22 within the flushing channel 44 tends to sweep out the entire flushing channel 44 from the exit passageway 20 to the outlet passageway 30 and along the entire circumference of the primary seal 24. Any leakage along the primary seal 24 thus results in air from the flushing channel 44, which has already been purified by passage through the filtering element. 16, entering the breathing space 50, rather than contaminated or unpurified air 52 from the ambient atmosphere.

The full face respirator of FIG. 1 is fixed on the user's head using straps 38. The straps 38 can be tightened to provide a snug fit using adjustment tabs or buckles 40. In that way a good seal is achieved between the primary seal 24 and the user's body and also between the secondary seal 26 and the user's body.

As shown in FIG. 3, one or more spacing elements 48 can be provided within the flushing channel 44. The spacing elements 48 assist in maintaining the flushing channel in an open configuration to allow the air freely to flow through the flushing channel 44 from the exit passageway 20 to the outlet passageway 30. Such spacing members 48 can comprise, for example, a spiral wire 48 (see FIG. 4) in the general shape of a cylinder or a perforated tube, as long as the spacing members 48 allow air freely to flow within the flushing channel 44. Since the spacing elements 48 come in contact with the user's skin, it is generally preferred that they, like all components which contact the skin, be prepared from, or coated with, materials that do not irritate the skin. Thus, the spiral wire spacing member 48 shown in FIG. 4 could be coated with silicone, plastic, or similar substances.

A hooded full-face respirator 110 is shown in FIG. 5. Respirator 110 is similar to the full-face respirator shown in FIG. 1 except for modifications associated with the hooded feature. Thus, a skirt 146, which covers the entire head, may extend down the shoulders for varying lengths until it terminates at a secondary seal 126. Since the secondary seal 126 in FIG. 5 is located generally at the user's neck, a flushing channel 144 is formed over a greater surface area. As shown in FIG. 5, the secondary seal 126 is preferably formed of an elastic member that fits snugly, but not tightly, around the user's neck. Additionally, the outlet passageway 130 comprises a tube having an inlet 129 within the flushing channel 144 and an outlet 131 wherein the air 122 passing through the flushing channel 144 exits to the ambient atmosphere as shown at 132. The secondary seal 126 in the hooded full-face respirator 110 of FIG. 5 could, if desired, be located at other positions so long as a flushing channel 144 is provided. Thus, for example, the secondary seal 126 could be located in the same or a similar position to that shown in FIG. 1.

Additional seals could also be incorporated into respirators in accordance with the invention. For example, the respirator 110 of FIG. 5 could have a secondary seal 126 in the same or a similar position to that shown in FIG. 1 to form a flushing channel 144 of similar configuration to that shown in FIG. 1. Respirator 110 could also be provided with a tertiary seal around the user's neck, for example, in the position of seal 126 in FIG. 5. In that case, contaminated air 52 (see FIGS. 2 and 3) from the ambient atmosphere would have to enter at the tertiary seal and move to and around the secondary seal before it could enter the flushing channel 144. Such contaminated air would then have to move through the flushing channel 144 and then around the primary seal before it could finally enter the breathing space 150. Thus, for significant amounts of contaminated air (or at least air not passing through the filtering elements 116) to reach the breathing space 150, numerous failures would be required.

The present flushing channel design can easily be incorporated into existing negative-pressure respirators. Such would be accomplished by providing a secondary seal to form a flushing channel, modifying the exit passageway or exhalation valve to channel exhaled air into the flushing channel, and providing an outlet passageway to exhaust air passing through the flushing channel back into the ambient atmosphere. Such modifications can easily be made in respirator design using conventional valves, filtering devices, facepieces, outer coverings, and the like and using conventional materials.

The following example is provided to illustrate the invention and not to limit it.

EXAMPLE

A prototype flushed-seal respirator in accordance with the present invention was constructed by modifying a commercially available, non-powered, full-face respirator. DuPont Tyvek® cloth was used to fabricate a hood. Inside the hood a spiral wire (coated with enamel and forming a cylinder with a diameter of about ⅝ inches) was used to shape a flow path or flushing channel with a secondary seal essentially as shown in FIG. 5. The flushing channel extended from the exit passageway or exhalation valve, around the outside circumference of the primary seal, to the forehead area of the respirator, where an outlet to the ambient atmosphere was provided. Overall, the modified respirator was similar to the respirator shown in FIG. 5.

The performance of the prototype was evaluated in several test chambers containing aerosolized corn oil to challenge the respirator. The concentration $C_o$ of aerosolized corn oil in the ambient atmosphere (i.e., outside the facepiece) and the concentration $C_i$ inside the breathing space were measured. The ratio $C_o/C_i$ i.e., the so-called protection factor PF, provides a measure of the protection provided by the respirator. The reciprocal of the protection factor PF is the leakage of the respirator; thus, a protection factor of 50 corresponds to a leakage of $1/50=0.02=2$ percent.

The concentration inside the breathing space was measured with a probe inserted through the facepiece window and placed about one-half inch from the user's skin surface and about half way between the user's nose and upper lip. The sample was drawn through the probe at a rate of approximately 5 liters/minute.

In the chamber, eight separate one-minute breathing exercises were conducted. The breathing exercises included (1) normal breathing; (2) deep breathing; (3) movement of the head from side to side; (4) movement of the head up and down; (5) talking; (6) frowning; (7) bending down; and finally (8) normal breathing again. The protection factor was measured for each exercise. This overall test method has been described and validated in previous studies (see, e.g., Coffey et al., "Comparison of Six Respirator Fit Test Methods With an Actual Measurement of Exposure in a Simulated Health-Care Environment: Part III-Validation Testing," *Am. Ind. Hyg. Assoc. J.,* 60:363–366 (1999)).

During several of the breathing exercises with the experimental design, momentary gaps appeared where the hood was secured to the neck of the subject (i.e., at the secondary seal). Certain head movements were found to have induced the gaps during the exercises. This occurred because the hood was poorly secured to the neck. The gaps allowed contaminated air to enter the flushing channel. It was concluded that the Tyvek® hood material was probably too stiff to get a reliable seal and this problem could be eliminated by a more flexible hood material. Alternatively, a more secure secondary seal (e.g., a seal as shown in FIG. 1) could be used. Even with this problem, the respirator with the operating flushing channel still performed significantly better than the control respirator, as will be seen in the data presented below.

Test Subject Number One: In this test (i.e., normal fit), the hood was first pulled forward so that the flushing channel, and thus the faceseal flushing effect, was eliminated. In this case the respirator performed as an ordinary full-face respirator and, thus, acted as a control. A female subject entered the Dynatech® test chamber with the hood pulled forward. Eight separate one-minute breathing exercises were conducted. The protection factor was measured for each exercise. The subject then left the chamber and, taking care not to modify or disturb the primary seal, the hood was put in place by a technician to form a secondary seal and, thus, a flushing channel. The subject then reentered the test chamber where the protection factors were again measured for the same eight exercises. The overall protection for both the control and the experimental design were calculated using the harmonic means of the protection factors for the eight exercises. The overall protection factor for the control was about 12,000; the overall protection factor for the experimental design was 20,000. Thus, even though this test subject using the control respirator was well protected (i.e., a very good face fit with a PF of 12,000), the faceseal flushing effect of the experimental design nearly doubled the protection factor, thereby provided significantly increased protection.

The tests were essentially repeated using the same subject under conditions where the faceseal (i.e., the seal between the primary seal and the subject's face) was poor. Using essentially the same experimental procedure as just described, leakage was introduced at the primary seal by inserting capillary tubes between the primary respirator seal and the subject's face. One capillary tube was inserted at the left temple area and another in the right cheek area. The chamber tests were then repeated using both the control and experimental designs. With the control respirator, the induced leaks reduced the overall protection factor to about 15 (i.e., a leakage of about 6.7 percent). With the hood in place (and, thus, the flushing channel in operation), the protection factor increased to 2900 (i.e., a leakage of about 0.03 percent). Thus, the flushing channel provided a dramatic increase in protection. Data for this subject are included in the table below:

| | Normal Fit | | Induced Leak | |
|---|---|---|---|---|
| Exercise | PF (control) | PF (flushed-seal) | PF (control) | PF (flushed-seal) |
| Normal Breathing | 4,234 | 18,959 | 12 | 10,844 |
| Deep Breathing | 8,342 | 32,538 | 17 | 23,534 |
| Move Head Side to Side | 27,654 | 23,705 | 14 | 4,840 |
| Move Head Up and Down | 32,496 | 17,906 | 15 | 532 |
| Talking | 25,073 | 29,210 | 22 | 11,767 |
| Frown | 21,591 | 32,855 | 17 | 14,149 |
| Bending Down | 8,827 | 8,472 | 14 | 3,217 |
| Normal Breathing | 19,264 | 30,633 | 13 | 10,332 |
| Overall | 11,683 | 20,158 | 15 | 2,873 |
| $PF_{flushed\text{-}seal}/PF_{control}$ | 1.7 | | 191.4 | |

Test Subject Number Two: Another female subject was tested in an ATI chamber using essentially the same protocol as the first subject except that the leakage was induced using only a single capillary tube placed under the primary seal at the left temple. Tests with a normal fit (i.e., no induced leakage) were not conducted with this test subject. Protection was dramatically increased with the hood (i.e., with the flushing channel in operation). For the control respirator with the induced leak, the overall protection factor was 13 (i.e., leakage of about 7.7 percent). With the experimental design and the induced leak, the overall protection factor was 320 (i.e., leakage of about 0.3 percent). Data for this subject are included in the table below:

| | Induced Leak | |
|---|---|---|
| Exercise | PF (control) | PF (flushed-seal) |
| Normal Breathing | 17 | 1,000,000 |
| Deep Breathing | 19 | 1,000,000 |
| Move Head Side to Side | 11 | 62 |
| Move Head Up and Down | 17 | 541 |
| Talking | 21 | 799 |
| Frown | 5 | 1,000,000 |
| Bending Down | 16 | 186 |

-continued

| Exercise | Induced Leak PF (control) | PF (flushed-seal) |
|---|---|---|
| Normal Breathing | 15 | 2,392 |
| Overall | 13 | 320 |
| $PF_{flushed\text{-}seal}/PF_{control}$ | 25.5 | |

Test Subject Number Three. Using a third female subject, the test procedure used for subject number one was essentially repeated except that, for the induced leak portion of the test, only a single capillary tube was placed under the primary seal in the left temple. Without any induced leak, the protection factor with the hood in place (i.e., with the flushing channel in operation) was almost 30,000; without the flushing channel (i.e., the control), the protective factor was only about 13,000. With the induced leak, the protection factor with the hood in place (i.e., with the flushing channel in operation) was over 5000 (i.e., leakage of about 0.02 percent); without the flushing channel (i.e., the control), the protective factor was only about 13 (i.e., leakage of about 7.7 percent). Data for this subject are included in the table below:

| Exercise | Normal Fit PF (control) | PF (flushed-seal) | Induced Leak PF (control) | PF (flushed-seal) |
|---|---|---|---|---|
| Normal Breathing | 8,277 | 17,812 | 20 | 8,679 |
| Deep Breathing | 6,324 | 32,556 | 26 | 17,286 |
| Move Head Side to Side | 13,416 | 32,631 | 26 | 9,703 |
| Move Head Up and Down | 14,271 | 32,805 | 27 | 936 |
| Talking | 26,647 | 32,759 | 42 | 14,550 |
| Frown | 24,253 | 32,836 | 31 | 30,005 |
| Bending Down | 15,615 | 32,836 | 26 | 29,855 |
| Normal Breathing | 27,477 | 32,836 | 25 | 29,665 |
| Overall | 13,273 | 29,643 | 27 | 5,285 |
| $PF_{flushed\text{-}seal}/PF_{control}$ | 2.2 | | 197.2 | |

As this example illustrates, the use of the flushed-seal respirator (i.e., a respirator having a flushing channel as described herein) can dramatically enhance the protection of a non-powered, negative-pressure, air-purifying respirator. The benefits of such a flushed-seal can be achieved in a simple and inexpensive manner. Moreover, the most pronounced enhancement in protection was achieved when it was most needed; that is when there was significant leakage in the primary seal and, thus, the poorest initial faceseal. Thus, in cases where leakage is more likely, the benefits of the present invention are the most significant.

We claim:

1. An air purifying respirator of the negative-pressure type comprising:

a respirator facepiece adapted for attachment to a user's head to cover at least the mouth and nose of the user, the facepiece being provided with a primary seal that forms a seal with the user's face to achieve a breathing space around the user's mouth and nose separate from the ambient atmosphere outside the breathing space, the facepiece being further provided with a first passageway to permit filtered air to enter the breathing space from the ambient atmosphere when the user inhales;

a hood configured to extend over the head and neck of a user providing a secondary seal attached to the respirator facepiece, the secondary seal in use forming a seal with the user's body to achieve a flushing channel separated from the breathing space and bounded by the user's body, the primary seal, the secondary seal and the hood, wherein the hood is comprised of flexible material;

a second passageway communicating between the breathing space and the flushing channel to permit air to pass from the breathing space into, and flow through the flushing channel when the user exhales;

an outlet passageway in the hood to permit air from the flushing channel to exit from the flushing channel into the ambient atmosphere, whereby any air that leaks through the primary seal into the breathing space is air flowing through the flushing channel; and at least one spacing element within the flushing channel to maintain the flushing channel in an open configuration.

2. The air purifying respirator of claim 1, wherein the secondary seal comprises an elastic member located on the hood and fits snugly, but not tightly around the user's neck.

3. The air purifying respirator of claim 1, wherein the spacing element comprises a spiral wire.

4. The air purifying respirator of claim 1, wherein the flushing channel is separated from the breathing space by the primary seal.

5. The air purifying respirator of claim 1, further comprising an air filter inlet disposed in the first passageway and comprising a filtering element and a check valve, whereby air from the ambient atmosphere passes through the filtering element into the breathing space when the user inhales, but air cannot pass through the filtering element in the reverse direction when the user exhales.

6. The air purifying respirator of claim 1, wherein the second passageway comprises an exhalation valve, whereby air can pass from the breathing space into the flushing channel when the user exhales, but air within the flushing channel cannot pass through the second passageway into the breathing space when the user inhales.

7. The air purifying respirator of claim 1, wherein the respirator is a full-face respirator wherein the user's eyes are also enclosed and the respirator facepiece comprises a viewing area.

8. The air purifying respirator of claim 1, wherein the at least one spacing element comprises multiple spacing elements disposed within the flushing channel.

9. An air purifying respirator of the negative-pressure type comprising:

a respirator facepiece adapted for attachment to a user's head to cover at least the mouth and nose of the user, the facepiece being provided with a primary seal that forms a seal with the user's face to achieve a breathing space around the user's mouth and nose separate from the ambient atmosphere outside the breathing space, the facepiece being further provided with a first passageway to permit filtered air to enter the breathing space from the ambient atmosphere when the user inhales;

a secondary seal attached to the respirator facepiece, the secondary seal in use forming a seal with the user's body to achieve a flushing channel separated from the breathing space and bounded by the user's body, the primary seal, the secondary seal and the respirator facepiece;

a spacing element within the flushing channel to maintain the flushing channel in an open configuration;

a second passageway communicating between the breathing space and the flushing channel to permit air to pass from the breathing space into, and flow through the flushing channel when the user exhales; and an outlet passageway in the respirator facepiece to permit air from the flushing channel to exit from the flushing channel into the ambient atmosphere, whereby any air that leaks through the primary seal into the breathing space is air flowing through the flushing channel;

wherein the spacing element comprises a spiral wire.

10. The air purifying respirator of claim 9, wherein the flushing channel is separated from the breathing space by the primary seal.

11. The air purifying respirator of claim 9, wherein the second passageway comprises an exhalation valve, whereby air can pass from the breathing space into the flushing channel when the user exhales, but air within the flushing channel cannot pass through the second passageway into the breathing space when the user inhales.

12. The air purifying respirator of claim 9, wherein the outlet passageway comprises a check valve to prevent air from outside the respirator from flowing into the flushing channel.

13. The air purifying respirator of claim 9, wherein multiple spacing elements are disposed within the flushing channel.

14. An air purifying respirator of the negative-pressure type comprising:

a respirator facepiece adapted for attachment to a user's head to cover at least the mouth and nose of the user, the facepiece being provided with a primary seal that forms a seal with the user's face to achieve a breathing space around the user's mouth and nose separate from the ambient atmosphere outside the breathing space, the facepiece being further provided with a first passageway to permit filtered air to enter the breathing space from the ambient atmosphere when the user inhales;

a hood comprised of flexible material and configured to extend over the head and neck of a user providing a secondary seal attached to the respirator facepiece, the secondary seal in use forming a seal with the user's body to achieve a flushing channel separated from the breathing space and bounded by the user's body, the primary seal, the secondary seal and the hood;

at least one spacing element within the flushing channel to maintain the flushing channel in an open configuration;

a second passageway communicating between the breathing space and the flushing channel to permit air to pass from the breathing space into, and flow through the flushing channel when the user exhales; and an outlet passageway in the hood to permit air from the flushing channel to exit from the flushing channel into the ambient atmosphere, whereby any air that leaks through the primary seal into the breathing space is air flowing through the flushing channel.

15. The air purifying respirator of claim 14, wherein the secondary seal comprises an elastic member located on the hood and fits snugly, but not tightly around the user's neck.

16. The air purifying respirator of claim 14, wherein the spacing element comprises a spiral wire.

17. The air purifying respirator of claim 14, wherein the flushing channel is separated from the breathing space by the primary seal.

18. The air purifying respirator of claim 14, wherein the outlet passageway comprises a check valve to prevent air from outside the respirator from flowing into the flushing channel.

19. The air purifying respirator of claim 14, wherein the respirator is a full-face respirator wherein the user's eyes are also enclosed and the respirator facepiece comprises a viewing area.

20. The air purifying respirator of claim 14, wherein multiple spacing elements are disposed within the flushing channel.

* * * * *